US005702135A

United States Patent [19]

Burress

[11] Patent Number: 5,702,135

[45] Date of Patent: Dec. 30, 1997

[54] CARTON CLOSURE APPARATUS

[76] Inventor: Paul J. Burress, 2 Valerie Ann Ct., Bloomington, Ill. 61704

[21] Appl. No.: 777,458

[22] Filed: Dec. 30, 1996

[51] Int. Cl.[6] ..... E05C 1/04; B65B 51/08

[52] U.S. Cl. ..... 292/145; 292/150; 292/DIG. 11; 53/416

[58] Field of Search ..... 292/8, 145, 146, 292/150, 156, 162, 281, DIG. 11; 24/625; 53/138.1, 416

[56] References Cited

U.S. PATENT DOCUMENTS

| | | | |
|---|---|---|---|
| 1,189,969 | 7/1916 | Kimball | 292/150 X |
| 2,850,343 | 9/1958 | Hubbard et al. | 292/145 X |
| 3,120,971 | 2/1964 | Bengtsson | 24/625 X |

FOREIGN PATENT DOCUMENTS

| | | | |
|---|---|---|---|
| 447379 | 5/1936 | United Kingdom | 24/625 |

*Primary Examiner*—Neill R. Wilson
*Attorney, Agent, or Firm*—Philip L. Bateman

[57] ABSTRACT

A carton closure apparatus releasably and securely closes a carton having a rectangular bottom, four side walls, two minor top flaps connected to the shorter two walls, and two major top flaps connected to the longer two walls. The apparatus has two parts. The first part is an insert that has a planar surface and a latching member that extends away from and at a right angle to the planar surface. The second part is a socket that has a receiving member for releasably and securely engaging the latching member of the insert. The socket is attached to one of the shorter side walls of the carton at a point along the top edge and equidistant from the adjoining side walls. When the two major top flaps are folded over the two minor top flaps and the insert is placed into the socket with the insert's planar surface extending over a portion of each of the major top flaps, the carton is releasably and securely closed.

11 Claims, 2 Drawing Sheets

CARTON CLOSURE APPARATUS

FIELD OF THE INVENTION

This invention relates to cartons having four folding top flaps. More particularly, this invention relates to an apparatus for releasably and securely closing such cartons.

BACKGROUND OF THE INVENTION

Corrugated cardboard cartons are widely used for packaging goods. The cartons are typically cut from a single piece of cardboard and are folded to form a rectangular top, a rectangular bottom, two shorter side walls, and two longer side walls. The term "rectangular" is used in its geometric sense and includes square shapes. When a carton has a square top and bottom, the shorter and longer side walls are, of course, the same length. The top and bottom of the carton are formed from four flaps connected to the side walls. Two minor flaps are attached to the shorter pair of side walls and two major flaps are attached to the longer pair of side walls. The minor top flaps typically do not meet when folded down whereas the major top flaps always meet or overlap. The top and bottom of the carton are sealed by first folding the minor flaps, then the major flaps, and then applying tape along the joint between the major flaps.

After the goods are shipped and unloaded, the cartons are frequently used for storage. The cartons are sometimes used to store the goods that were originally shipped in them and are sometimes to store other goods. Although packaging cartons are sturdy, there currently is no satisfactory way of releasably and securely closing the top flaps of the carton when the carton is used for storage. The cartons are sometimes closed by folding down the minor flaps and then the major flaps. However, the major flaps do not lay flat and a gap is inevitably left. The gap allows dust, bugs, and the like to enter the carton. The major flaps can be tied or taped down, but this requires additional material and additional time. Another way of closing a storage carton is to first fold a major flap down, then a minor flap, then the remaining major flap, and finally the remaining minor flap. One end of the last minor flap is tucked under the first major flap to create a relatively secure inter-locking top. Unfortunately, the top is not flat and the flaps eventually tear along the seam due to the stress applied when folding.

Richardson, U.S. Pat. No. 2,918,319, issued Dec. 22, 1959, discloses an apparatus for locking a detachable lid onto a box. The apparatus has two components. The first component is a socket that is inserted through a slot in the side wall of the box and then folded to secure it in position. The second component is a hook that is inserted through a slot in the lid and engages the socket in the space that must exist between the side walls of the lid and the side walls of the box. The apparatus is unlocked by straightening the hook member, disengaging it from the socket, and then withdrawing it through the slot in the lid. The Richardson apparatus is reusable to some degree, but repeated bending and straightening would break the soft metal hook member. Furthermore, the Richardson apparatus is not usable with standard cartons because they do not have overlapping lids.

King et al., U.S. Pat. No. 4,761,935, issued Aug. 9, 1988, discloses a clip for holding the two major flaps of a carton together. When there is no load on a carton having the clip, the major flaps tend to rise and leave gaps. When there is a load on a carton, the portion of the clip under the flap prevents the flaps from resting flush upon the side walls.

A need still exists for a carton closure apparatus that is reusable, secures the top flaps in a flat position to facilitate stacking and to eliminate gaps, is out of the way when the carton is opened, fits any carton, does not damage the carton, and is not easily lost.

SUMMARY OF THE INVENTION

The general object of this invention is to provide an improved apparatus for closing cartons. A more particular object is to provide such apparatus that is reusable in two senses: (1) it can repeatedly be latched and released so the carton can be opened and closed again as many times as desired; and (2) it can be moved from carton to carton. Another more particular object is to provide such an apparatus that secures the top flaps in a flat position so that other things can be stacked on the carton and so that gaps are eliminated. Other objects are to provide such an apparatus that is out of the way when the carton is opened, fits any carton, does not damage the carton, and is not easily lost.

I have invented an improved carton closure apparatus for releasably and securely closing a carton having a rectangular bottom, two shorter side walls having a top edge and a bottom edge, two longer side walls having a top edge and a bottom edge, two minor top flaps connected respectively to the shorter side walls along their top edges, and two major top flaps connected respectively to the longer side walls along their top edges. The apparatus comprises: (a) an insert having a rigid planar surface with a straight-edged side and also having a latching member extending away from and at a right angle to the straight-edged side; and (b) a socket having a planar surface and also having a fastener for attaching one side of the planar surface flush against a side wall of a carton, the other side of the planar surface having a receiving member for releasably and securely engaging the latching member of the insert. When the socket is attached to one of the shorter side walls of a carton at a point along the top edge and equidistant from the adjoining longer side walls, and when the two major top flaps are folded over the two minor top flaps, and when the insert is latched into the socket with the insert's planar surface extending over a portion of each of the major top flaps, then the carton is releasably and securely closed.

The carton closure apparatus of this invention is reusable. In other words, a carton containing this device can be opened and closed countless times without damaging the carton closure apparatus itself. Furthermore, the apparatus can be moved easily from carton to carton. The apparatus secures the top flaps in a flush position so that other things can be stacked on the carton and so there are no gaps that might allow dust or bugs to enter. The apparatus is out of the way when the carton is opened. The carton is not damaged in any way by use of the apparatus. The carton closure apparatus fits any carton and is not easily lost.

DETAILED DESCRIPTION OF THE INVENTION

Figure 1:
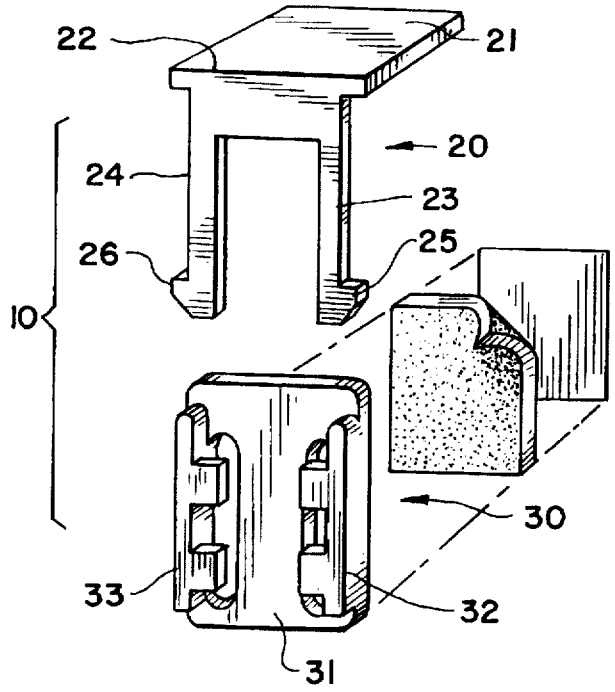
FIG. 1 is a perspective view of the preferred embodiment of the carton closure apparatus of this invention showing the two components of the apparatus in a separated position.
Figure 2:
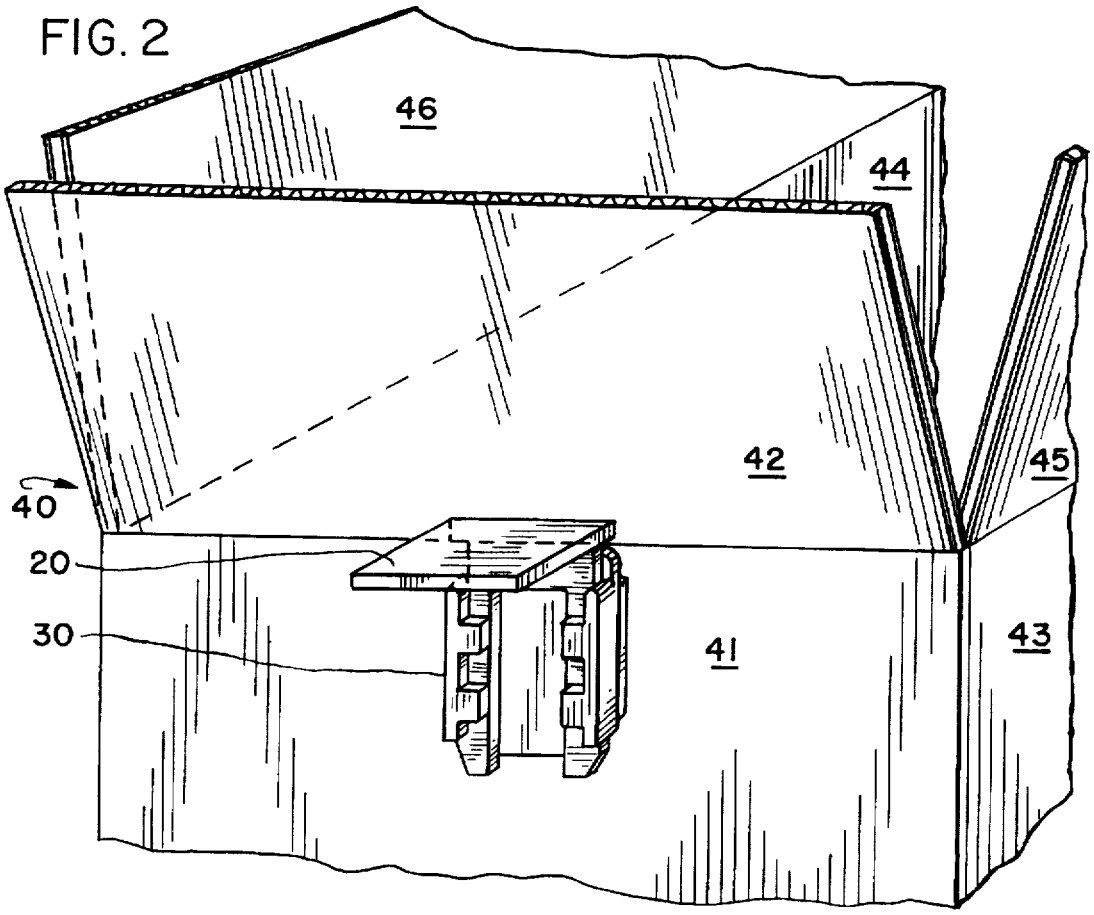
FIG. 2 is a perspective view of the device shown in FIG. 1 in place on a carton in the open position.
Figure 3:
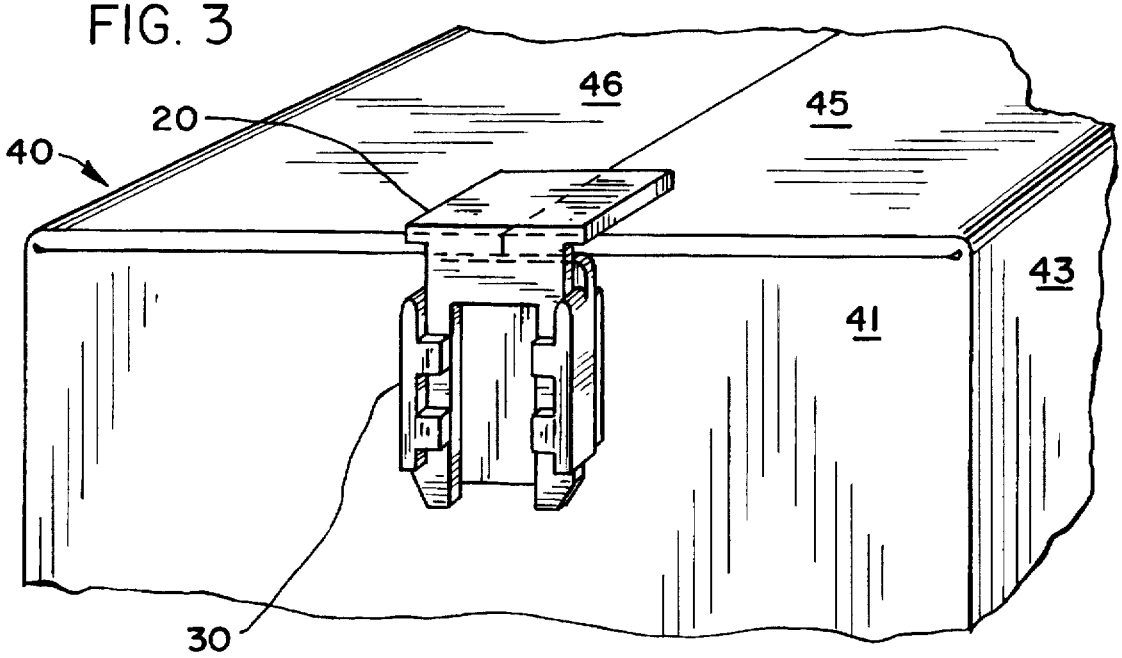
FIG. 3 is a perspective view of the device shown in FIG. 1 in place on a carton in the closed position.

This invention is best understood by reference to the drawings. FIGS. 1–3 show the preferred embodiment of the carton closure apparatus of this invention. The apparatus 10 contains two components—an insert 20 and a socket 30. FIGS. 2 and 3 show the apparatus in use on a carton 40.

The insert contacts and holds down the two major top flaps of the carton when the carton is closed, as seen in FIG. 3. The part of the insert that contacts the flaps is a rigid thin planar surface 21. The planar surface is thin so that it does not project far above the top surface of the carton. The flat top surface of the carton enables other cartons, boxes, and the like to be stacked on top of it without tipping. The thickness of the planar surface is generally about 1 to 5 mm, and preferably about 2 to 3 min.

The planar surface's width and depth are matters of choice, provided the surface is large enough to contact and hold down both major top flaps. In general, both the width and the depth are about 1 to 10 cm, and are preferably about 2 to 5 cm, for household use. Larger sizes can be used with household cartons, but the additional cost and bulk outweigh any improvement in the functioning. Larger sizes are more advantageously used in industrial settings with cartons having height, width, and depth dimensions of more than about one meter.

At least one side of the planar surface is a straight edge so that the insert conforms to the edge of the carton. In the preferred embodiment shown, the planar surface is rectangular in shape and contains four straight edges. A rectangular shape most effectively maintains contact with both major top flaps. However, edge 22 is the only one of the four edges that must be straight. Other shapes are also suitable, including half-circles and irregular shapes.

The insert contains a latching member for securing it to the socket. The latching member extends away from, and at a right angle to, the straight edge side of the planar surface. A large number of latching mechanisms are known in the art and are suitable. For example, suitable latching mechanisms are disclosed in Buick, U.S. Pat. No. 2,292,429, issued Aug. 11, 1942; Kreck, U.S. Pat. No. 3,600,917, issued Aug. 24, 1971; Isenmann, U.S. Pat. No. 3,979,934, issued Sep. 14, 1976; and Skobel, U.S. Pat. No. 4,408,375, issued Oct. 11, 1983. It is preferable that the latching member be one that has an identical front and back so that it can be latched into the socket from either side. The preferred latching member is a pair of resilient elongated bifurcated legs 23 and 24. Each leg contains a barb 25 and 26 at its end. Each barb points in a direction opposite the other leg. The legs are generally about 2 to 12 cm long, and are preferably about 3 to 6 cm long.

The insert is preferably made of a material that has some resiliency so it can be deformed and yet return to its original shape. Preferred materials include plastics such as acrylonitrile-butadiene-styrene (ABS), nylon, polyethylene, polypropylene, polystyrene, polycarbonate, and the like. These plastics are readily injection molded. The most preferred material is acrylonitrile-butadiene-styrene because an insert made of this material and having the shape shown in FIGS. 1–3 has the optimal amount of resiliency in its legs.

The socket is attached to a side wall of the carton and engages the latching mechanism of the insert. The socket has a planar surface 31 that rests flush against a side wall. The socket contains a fastener for attaching the socket to the side wall. A variety of fasteners are known in the art and are suitable. The preferred fastener is a section of two-sided adhesive foam 32. One side of the adhesive foam sticks to the back of the planar surface of the socket and the other side is covered with a piece of removable tape 33. The tape is removed to expose the adhesive and the socket is then fastened to the side wall of the carton. An example of two-sided adhesive foam is SCOTCH heavy duty mounting squares, a commercial product of the 3M Company, St. Paul, Minn. These products are preferred for several reasons. They fasten the socket quickly, easily, and securely to the carton, but yet can be easily removed. They are also available in a wide range of precut sizes and replacement sections are easily applied to the socket.

The front side of the socket's planar surface contains a receiving member for releasably and securely engaging the latching member of the insert. The shape of the receiving member depends, of course, on the shape of the latching member. The preferred embodiment of the socket contains slots 34 and 35 that receive the legs of the insert and engage the barbs. When the barbs are engaged, upward travel of the insert is limited. This, in turn, ensures that the insert maintains the major top flaps in a flat position.

The use of the carton closure apparatus of this invention can now be considered. The first stop is to obtain a standard carton that is to be used for storage. Such a carton 40 is shown in FIGS. 2 and 3. It has a rectangular bottom (not shown), one shorter side wall 41 with minor top flap 42 attached to it along its top edge, a second shorter side wall and minor top flap (not shown), and two longer side walls 43 and 44 with major top flaps 45 and 46 connected to them along their top edges. The socket is attached to one of the shorter side walls along its top edge, as shown in FIGS. 2 and 3. The exact position of the socket with respect to the top edge is dictated by the structure of the latching mechanism—the insert should be latched only when the top flaps are in a flat position (when the carton is closed). The socket is positioned equidistant from the adjoining longer side walls so that it is located adjacent the point where the major top flaps meet. In this position, the insert makes contact with both major top flaps. If the top flaps overlap, the socket's location along the top edge is not quite so critical because the insert need only contact the major top flap that overlaps the other major top flap.

When the carton is to be closed, the two minor top flaps are folded down first. The two major top flaps are then folded down. The insert is then oriented with its planar surface over the top flaps and pushed down into the socket. If desired, a second carton closure device can be used on the other shorter side wall. The carton is thus closed with the four flaps in their designed positions. The carton closure device holds the flaps down securely in a manner similar to that achieved with tape or string. There is no gap between the major flaps and the top of the carton is flat and conducive to stacking.

When the carton is to be opened, the legs of the insert are squeezed together and the insert is slid upwards out of the socket. To prevent loss or misplacement, the insert is first rotated 180° about its vertical axis so that its planar surface extends away from the carton. The insert is then pushed down into the socket as shown in FIG. 3. The device is now out of the way of the flaps and the carton can be opened and loaded or unloaded as if the device were not present.

Figure 4:
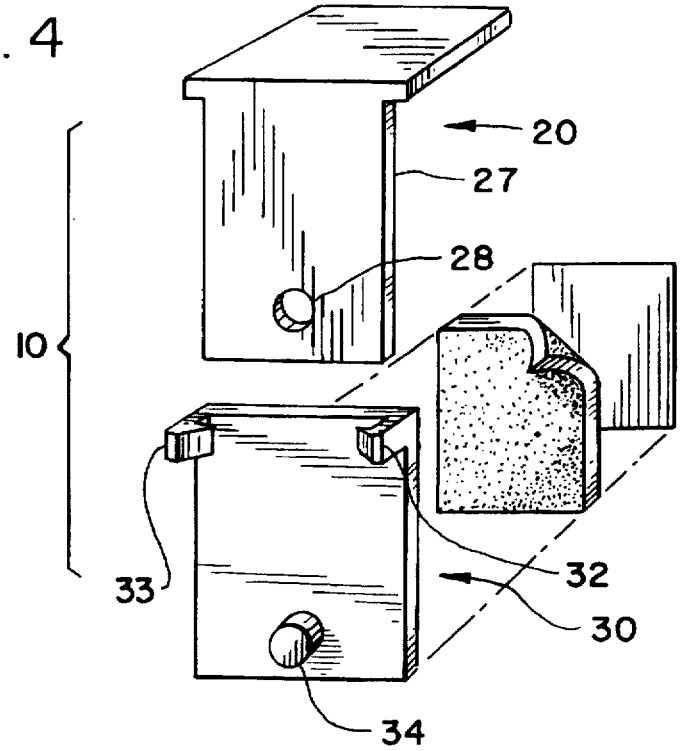
FIG. 4 is a perspective view of an alternate embodiment of the carton closure apparatus of this invention showing the two components of the apparatus in a separated position.

An alternate embodiment of the carton closure apparatus is shown in FIG. 4. The latching member of the insert is a tongue 27 with a hole 28. The tongue is engaged by the receiving member of the socket by first sliding the tongue through slots 34 and 35, then bending the tongue outward over knob 36, and finally allowing the hole to slide over the knob.

The carton closure apparatus of this invention is reusable in the sense that it can be latched and unlatched countless times while attached to a single carton. The apparatus is also reusable in the sense that it can be easily moved from carton to carton. The apparatus secures the top flaps in a flat position so that other things can be stacked on the carton and so there are no gaps that might allow dust or bugs to enter. The apparatus is out of the way when the carton is opened. The carton is not damaged in any way by use of the apparatus. The carton closure apparatus fits any carton and is not easily lost.

I claim:

1. A carton closure apparatus for releasably and securely closing a carton having a rectangular bottom, two shorter side walls having a top edge and a bottom edge, two longer side walls having a top edge and a bottom edge, two minor top flaps connected respectively to the shorter side walls along their top edges, and two major top flaps connected respectively to the longer side walls along their top edges, the carton closure apparatus comprising:

(a) an insert having a rigid planar surface with a straight-edged side and also having a latching member extending away from and at a right angle to the straight-edged side, the latching member having an identical front and back; and (b) a socket having a planar surface and also having a fastener for attaching one side of the planar surface flush against a side wall of a carton, the other side of the planar surface having a receiving member for releasably and securely engaging the latching member of insert;

such that, when the socket is attached to one of the shorter side walls of a carton at a point along the top edge and equidistant from the adjoining longer side walls, and when the two major top flaps are folded over the two minor top flaps, and when the insert is latched into the socket with the insert's planar surface extending over a portion of each of the major top flaps, then the carton is releasably and securely closed: and such that the insert can also be latched into the socket with the insert's planar surface extending away from the major top flaps so the carton can be opened and loaded or unloaded as if the carton closure apparatus were not present.

2. The apparatus of claim 1 wherein the latching member of the insert comprises two resilient elongated bifurcated legs, each leg having a barb at its end farthest away from the planar surface.

3. The apparatus of claim 2 wherein the receiving member of the socket comprises slots for receiving the legs of the insert and for engaging the barbs.

4. The apparatus of claim 3 wherein the insert is made of plastic.

5. The apparatus of claim 4 wherein the fastener comprises two-sided adhesive foam.

6. A carton closure apparatus for releasably and securely closing a carton having a rectangular bottom, two shorter side walls having a top edge and a bottom edge, two longer side walls having a top edge and a bottom edge, two minor top flaps connected respectively to the shorter side walls along their top edges, and two major top flaps connected respectively to the longer side walls along their top edges, the carton closure apparatus comprising:

(a) an insert having a rigid planar surface with a straight-edged side and also having a latching member extending away from and at a right angle to the straight-edged side, the planar surface and the latching member having dimensions perpendicular to the straight edged side that are about equal; and (b) a socket having a planar surface and also having a fastener for attaching one side of the planar surface flush against a side wall of a carton, the other side of the planar surface having a receiving member for releasably and securely engaging the latching member of the insert;

such that, when the socket is attached to one of the shorter side walls of a carton at a point along the top edge and equidistant from the adjoining longer side walls, and when the two major top flaps are folded over the two minor top flaps, and when the insert is latched into the socket with the insert's planar surface extending over a portion of each of the major top flaps, then the carton is releasably and securely closed.

7. The apparatus of claim 6 wherein the means for latching of the insert has an identical front and back so it can be latched into the socket in one of two ways, with the insert's planar surface extending over the major top flaps or with the planar surface extending away from the major top flaps.

8. The apparatus of claim 7 wherein the means for latching of the insert comprises two resilient elongated bifurcated legs, each leg having a barb at its end farthest away from the planar surface.

9. The apparatus of claim 8 wherein the means for engaging of the socket comprises slots.

10. The apparatus of claim 9 wherein the insert is made of plastic.

11. The apparatus of claim 10 wherein the means for fastening comprises two-sided adhesive foam.

* * * * *